United States Patent [19]

Mutschler, Jr.

[11] 4,326,915

[45] Apr. 27, 1982

[54] SHEET DE-CURLER

[75] Inventor: Edward C. Mutschler, Jr., Pittsford, N.Y.

[73] Assignee: Xerox Corporation, Stamford, Conn.

[21] Appl. No.: 94,606

[22] Filed: Nov. 15, 1979

[51] Int. Cl.[3] ..... D21F 1/40; D21H 1/00; D21J 1/14

[52] U.S. Cl. ..... 162/271; 271/272; 355/3 SH

[58] Field of Search ..... 355/3 R, 3 SH, 14 SH; 271/272, 273, 274; 162/270, 271

[56] References Cited

U.S. PATENT DOCUMENTS

| | | | |
|---|---|---|---|
| 2,658,432 | 11/1953 | Baumgartner | 162/271 X |
| 2,918,897 | 12/1959 | Zernov | 162/271 X |
| 3,411,768 | 11/1968 | Gatti | 271/272 X |
| 3,501,375 | 3/1970 | Suzuki et al. | 162/271 |
| 3,661,703 | 5/1972 | Shelor | 162/270 X |
| 4,002,047 | 1/1977 | MacPhee et al. | 72/160 |
| 4,013,284 | 3/1977 | Demetre | 271/183 |
| 4,060,236 | 11/1977 | Carstedt | 271/183 |
| 4,119,309 | 10/1978 | Mayer et al. | 271/183 |

FOREIGN PATENT DOCUMENTS

| | | | |
|---|---|---|---|
| 2059532 | 6/1972 | Fed. Rep. of Germany | 162/270 |
| 478048 | 2/1938 | United Kingdom . | |
| 1094189 | 12/1967 | United Kingdom . | |
| 1360191 | 7/1974 | United Kingdom . | |
| 1434102 | 5/1976 | United Kingdom . | |

OTHER PUBLICATIONS

Acquaviva, Thomas; "Lead Edge Curl for Stripping"; Xerox Disclosure Journal; vol. No. 4, Jul./Aug. 1979; pp. 513 and 514.

*Primary Examiner*—Fred L. Braun
*Attorney, Agent, or Firm*—H. Fleischer; H. M. Brownrout

[57] ABSTRACT

An apparatus in which sheet material is decurled. The apparatus presses the sheet material into contact with a substantially rigid arcuate member in at least two regions. In this way, the sheet material moves about the arcuate member in a curved path to remove the curl therein.

7 Claims, 3 Drawing Figures

SHEET DE-CURLER

This invention relates generally to an electrophotographic printing machine, and more particularly concerns an apparatus for de-curling sheet material employed therein.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition, curled sheets tend to frequently produce jams or misfeeds within the printing machine. Hereinbefore, this problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the de-curler is not necessarily consistent with that required in electrophotographic printing machines. In addition, de-curlers of this type generally have a high running torque necessitating significant power inputs to operate successfully. Moreover, on many occasions, in electrophotographic printing, devices previously employed smeared the powder image.

Various approaches have been devised to improve sheet de-curlers. The following disclosures appear to be relevant:

U.S. Pat. No: 4,002,047; Patentee: MacPhee et al.; Filed: Jan. 11, 1977.

U.S. Pat. No: 4,013,284; Patentee: Demetre; Filed: Mar. 22, 1977.

U.S. Pat. No: 4,060,236; Patentee: Carstedt; Filed: Nov. 29, 1977.

U.S. Pat. No: 4,119,309; Patentee: Mayer et al.; Filed: Oct. 10, 1978.

Xerox Disclosure Journal Vol. 4, No. 4; July/August 1979, page 513; By: T. Acquaviva The pertinent portions of the foregoing disclosures may be briefly summarized as follows:

MacPhee et al. describes a sheet material decurling apparatus in which a conveyor draws a curled sheet across a trough connected to a vacuum pump. A sheet being pulled across the top of the trough is drawn down into the trough. This operation imparts a bend to the sheet which is opposite to the natural curl of the sheet.

Demetre discloses a de-curler having a rounded M-shaped suction bar coupled to a vacuum pump. As the sheet moves over the suction bar, the sheet is drawn into the trough by the vacuum. This progressively bends the sheet in the opposite direction to the original direction of curl.

Carstedt describes a de-curler unit including a pair of parallel elongated support surfaces extending transversely across the width of a sheet being advanced by grippers mounted on a conveyor. The support forms a V-shaped surface over which the sheet passes. The vacuum pump is coupled to a chamber which, in turn, is in communication with the support surface via suitable ports. As the sheet material passes over the support surface, the vacuum draws the sheet thereagainst to continuously bend the sheet so as to counteract the natural tendency of the sheet to curl.

Mayer et al. teaches a device for flattening sheets that includes a pair of beam-like support members. The support members are curved to form cylindrical crown surfaces having a large radius of curvature. The two surfaces are spaced to define a groove therebetween. A vacuum is applied to the groove so that the sheet undergoes a bend to counteract the curling tendency thereof.

Acquaviva discloses a pair of coining rolls arranged to produce curvature in a sheet passing therebetween. One roll is made from a soft rubber material and the other roll has a hard surface. When the lead edge of a moving sheet reaches a registration switch, a signal is generated which starts the coining rolls rotating. The hard roll rotates about 180° so that the sheet is driven therebetween by the soft roll. In this way, the sheet is curled.

In accordance with the features of the present invention, there is provided an apparatus for de-curling sheet material. The apparatus includes at least one substantially rigid, arcuate member. Substantially rigid means engage the arcuate member in at least two regions. The rigid means move the sheet material in a curved path through the regions to bend the sheet material so as to remove the curl therein.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
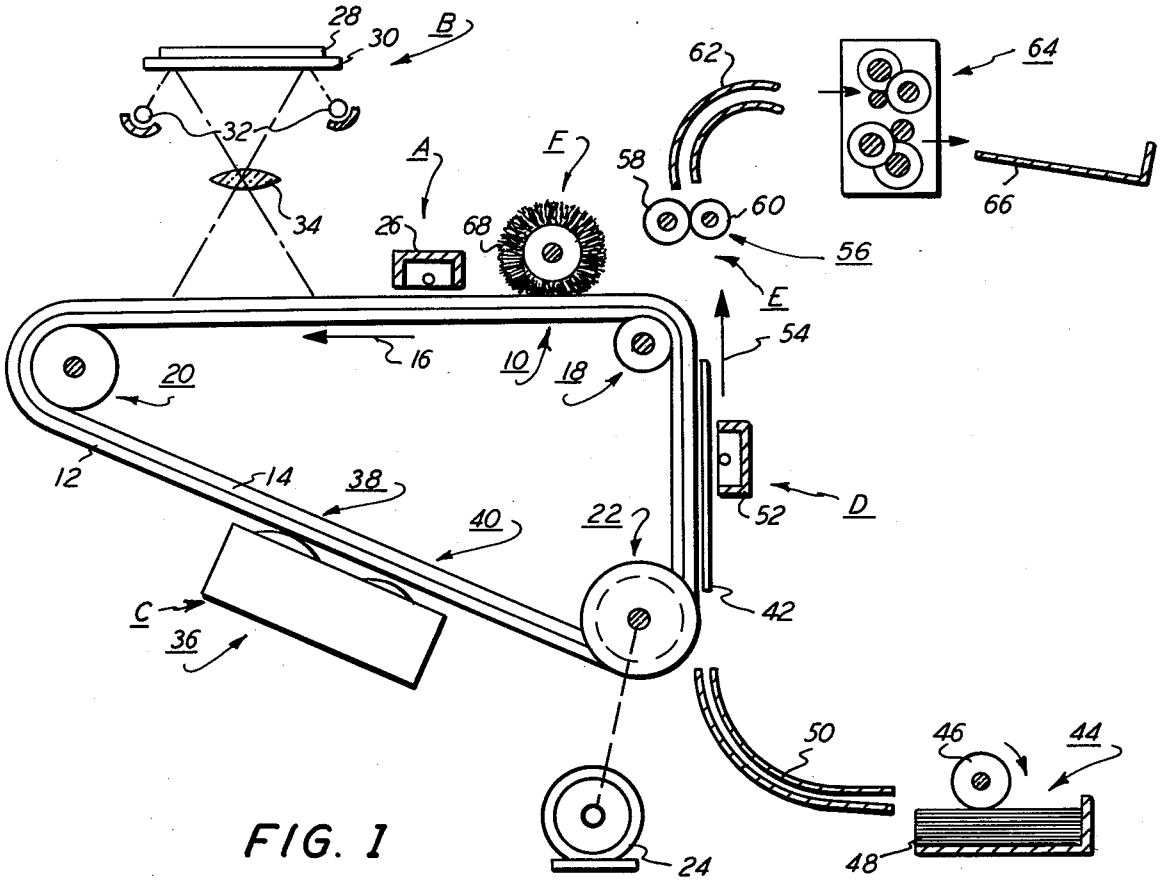
FIG. 1 is an elevational view illustrating schematically an electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the de-curling apparatus of the present invention therein. It will become evident from the following discussion that the curling apparatus is equally well suited for use in a wide variety of printing machines and is not necessarily limited in its application to the particular embodiment shown herein. In addition, the location of the de-curling apparatus, as depicted in the FIG. 1 electrophotographic printing machine, may be varied. The de-curling apparatus may be positioned intermediate any of the processing stations within the printing machine. In the printing machine depicted in FIG. 1, the curling apparatus is positioned after the fusing station prior to the catch tray so as to straighten the final copy sheet prior to removal from the printing machine by the operator. However, this location is merely illustrative of the operation of the de-curling apparatus and may be varied.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential.

Thereafter, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly thereform. The toner particles are attracted from the carrier granules to the electrostatic latent image forming a toner powder image on photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is heated so as to be permanently affixed to sheet 42. After fusing, sheet 62 guides advancing sheet 42 to the de-curling apparatus, indicated generally by the reference numeral 64. At this time, the sheet of support material has undergone numerous processes and very frequently contains undesired curls therein. This may be due to the various processes through which it has been subjected, or to the inherent nature of the sheet material itself. De-curling apparatus 64 bends the sheet of support material so that the sheet material is strained to exhibit plastic characteristics. After passing through de-curling apparatus 64, the sheet of support material is advanced into catch tray 66 for subsequent removal from the printing machine by the operator. The detailed structure of de-curling apparatus 64 will be described hereinafter with reference to FIGS. 2 and 3.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrophotographic printing machine incorporating the features of the present invention therein.

Figure 2:
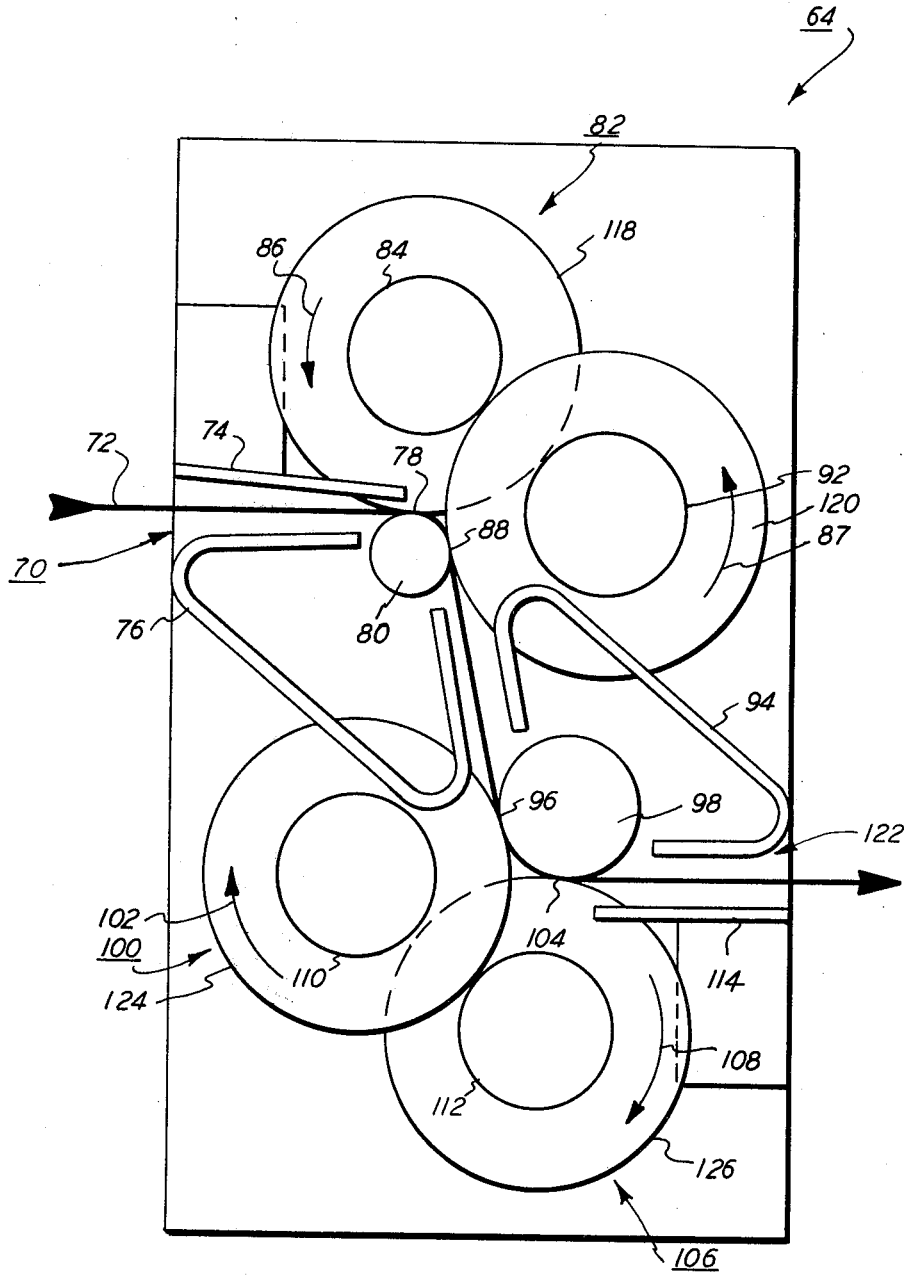
FIG. 2 is an elevational view showing the de-curling apparatus of the present invention used in the FIG. 1 printing machine.

Referring now to the specific subject matter of the present invention, FIG. 2 depicts de-curling apparatus 64 in greater detail. De-curling apparatus 64 removes the curls in the sheet of support material by straining the sheet of support material about a small diameter roll. The de-curling apparatus is compact permitting space constraints to be optimized. Bearing loads are relatively low. Since bearing loads are low, hysteresis losses are substantially eliminated. In addition, the torque required to drive the system is significantly reduced minimizing power requirements. Finally, inasmuch as the entire system rotates at substantially the same surface velocity, image smearing is eliminated. Turning now to the specifics of the de-curling apparatus, de-curling apparatus 64 includes a sheet guide, indicated generally by the reference numeral 70. As the sheet of support material advances in the direction of arrow 72, it passes between sheet metal guides 74 and 76. Preferably, sheet metal guide 74 is substantially flat with sheet metal guide 76 being arranged in a triangular configuration. Sheet guide 70 directs the sheet of support material into the first contact region 78 which is defined by a substantially rigid cylindrical rod 80 pressing against a substantially rigid roller indicated generally by the reference numeral 82. Roller 82 includes a plurality of spaced apart tubes 118 mounted on a cylindrical shaft 84. The foregoing is shown more clearly in FIG. 3. Roller 82 rotates in the direction of arrow 86 so as to continue to move the sheet in the direction of arrow 72. As roller 82 rotates, the sheet of support material advances in the direction of arrow 72 and bends around cylindrical rod 80. As the lead edge of the sheet of support material bends around cylindrical rod 80, it enters into a second contact region 88. Contact region 88 is defined by a roller, indicated generally by the reference numeral 90, pressing against cylindrical rod 80. Roller 90 rotates in the direction of arrow 87 so as to continue to advance the sheet of support material in the direction of arrow 72. Roller 90 comprises a plurality of spaced apart tubes 120 mounted on shaft 92. Tubes 120 of roller 90 are positioned to interfit in the spaces between tubes 118 of roller 82. Similarly, tubes 118 of roller 82 are positioned to interfit in the spaces between tubes 120 of roller 90. Roller 90 is substantially rigid. It is thus clear that the sheet of support material bends about cylindrical rod 80 and passes through two hard contact regions or nips 78 and 88, respectively. This bending process strains the sheet of support material.

After the sheet of support material exits nip 88, triangularly shaped guide 94 of sheet guide 122 in conjunction with triangular shaped guide 76 of sheet guide 70 directs the sheet of support material into contact region 96. Contact region 96 is defined by cylindrical rod 98 pressing against roller 100. Both cylindrical rod 98 and roller 100 are substantially rigid. Roller 100 rotates in the direction of arrow 102 so as to continue to advance the sheet of support material in the direction of arrow 72. As the sheet of support material advances in the direction of arrow 72, it leaves contact region 96 and enters contact region 104. Contact region 104 is defined by rod 98 pressing against roller 106. Roller 106 rotates in the direction of arrow 108. As the sheet of support material advances from contact region 96 to contact region 104, the sheet bends around cylindrical rod 98. Roller 106 is also substantially rigid. Hence, contact regions or nips 96 and 104 are relatively hard. As the sheet of support material bends around substantially rigid cylindrical rod 98, it is strained so as to remove the curl therein. It is clear that the sheet of support material initially bends in one direction about arcuate member or rod 80 and then, subsequently, about arcuate member or rod 98 in the opposite direction. Hence, the sheet of support material is strained in two mutually opposite directions so as to remove any curl therein.

Both rollers 100 and 106 include a plurality of spaced apart tubes 124 and 126, respectively, mounted on shafts 110 and 112, respectively. Tubes 124 of roller 100 are arranged to interfit in the spaces between tubes 126 of roller 106. Similarly, tubes 126 of roller 106 are arranged to interfit in the spaces between tubes 124 of roller 100. In this way, the rollers 100 and 106 are interleafed with one another.

Roller 106 rotates in the direction of arrow 108 so as to advance the sheet in the direction of arrow 72. After passing through nip 104, the sheet of support material is guided to catch tray 66 (FIG. 1) by triangular shaped guide 94 and by substantially flat guide 114 of sheet guide 122. Sheet guide 122 is preferably made from sheet metal.

By way of example, all of the rollers are preferably made from a substantially rigid material such as stainless steel. Similarly, the cylindrical rods are also made from a substantially rigid material such as stainless steel. The cylindrical rods are free to rotate whereas at least one of each pair of rollers is driven so as to advance the sheet of support material through the contact regions. Inasmuch as the sheet of support material is strained about each of the cylindrical rods so as to bend in opposed directions, any curl therein is removed therefrom.

Preferably, rollers 82, 90, 100 and 106 all have substantially the same radius of curvature. However, the radii of curvature of rollers 82, 90, 100 and 106 are substantially greater than the radii of curvature of cylindrical rods 80 and 98. In addition, cylindrical rod 98 has a greater radius of curvature than cylindrical rod 80.

Figure 3:
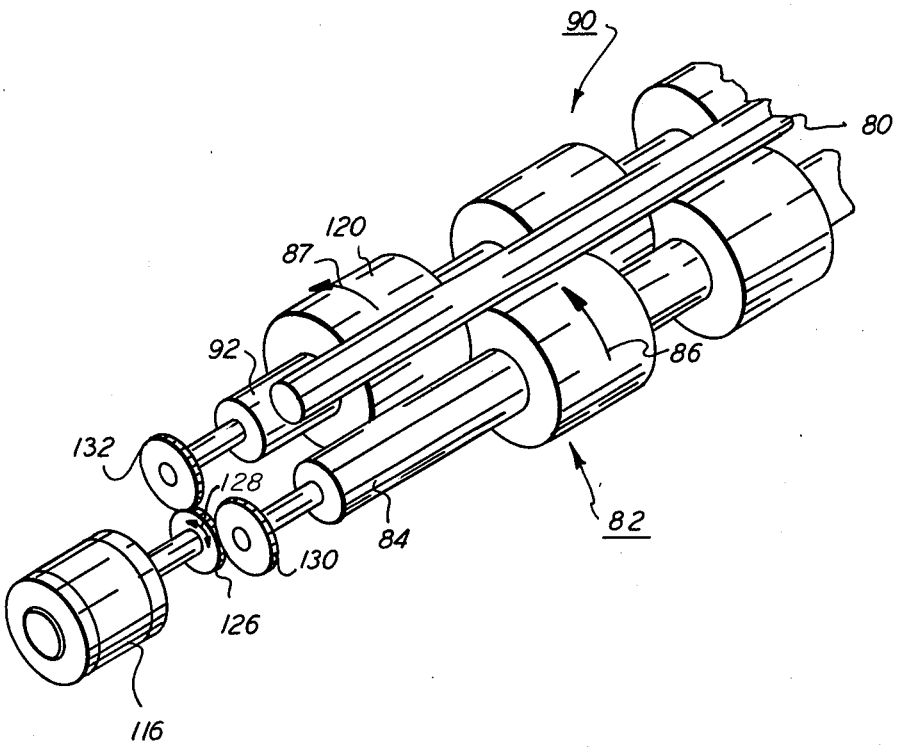
FIG. 3 is a fragmentary perspective view depicting a portion of the FIG. 2 de-curling apparatus.

Referring now to FIG. 3, there is shown a fragmentary perspective view depicting rod 80 and rollers 82 and 90. This arrangement is substantially identical to the arrangement of rod 98 and rollers 100 and 106. Inasmuch as the arrangement is substantially identical, only the former will be discussed. Any distinction between the two arrangements resides merely in their respective locations and that one set of rollers and its corresponding cylindrical rod bend the sheet of support material in one direction while the other set of rollers and its corresponding cylindrical rod bend the sheet of support material in the opposite direction. As shown in FIG. 3, motor 116 rotates gear 126 in the direction of arrow 128. Gear 126 meshes with gear 130 mounted on shaft 84 and gear 132 mounted on shaft 92. Motor 116 rotates at a constant speed to rotate roller 82 in the direction of arrow 86 and roller 90 in the direction of arrow 87.

Tubes 118 are mounted in a spaced apart relationship on shaft 84. Similarly, tubes 120 are mounted in a spaced apart relationship on shaft 92. Cylindrical rod 80 engages both tubes 118 and tubes 120 in contact regions 78 and 88 (FIG. 2), respectively. Tubes 118 are positioned on shaft 84 so as to mesh with tubes 120 on shaft 92. This results in tubes 118 and 120 being interleafed with one another. Inasmuch as rollers 82 and 90 rotate at substantially the same surface velocity, there is no slippage between the sheet and the rollers, thereby minimizing smearing of the image formed on the sheet material.

In recapitulation, it is apparent that the de-curling apparatus of the present invention strains the sheet of support material by bending it in opposite directions, about substantially rigid arcuate members. The sheet of support material passes between a first pair of hard contact regions so as to initially bend in a first direction and, thereafter, between a second pair of hard contact regions so as to bend in a second direction opposed to the first direction. The straining of the sheet of support material in opposed directions substantially eliminates any curl therein.

It is, therefore, evident that there has been provided, in accordance with the present invention an apparatus for de-curling a sheet of support material being used in an electrophotographic printing machine. This apparatus fully satisfies the aims and advantages hereinbefore set forth. While this invention has been described in conjunction with a specific embodiment thereof, it is evident that any alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for de-curling sheet material, including:

a first substantially rigid rod;

a first pair of substantially rigid rollers, one of said first pair of rollers contacting said first rod in a first contact region and the other of said first pair of rollers contacting said first rod in a second contact region;

means for rotating said first pair of rollers to move the sheet material through the contact regions to bend the sheet material about said first rod in a first direction;

a second substantially rigid rod;

a second pair of substantially rigid rollers, one of said second pair of rollers contacting said second rod in a first contact region and the other of said second pair of rollers contacting said second rod in a second contact region; and means for rotating said second pair of rollers to move the sheet through the contact regions to bend the sheet material in a second direction opposed to the first direction.

2. An apparatus as recited in claim 1, wherein each of said first pair of rollers includes;

a cylindrical shaft; and a plurality of spaced apart tubes mounted on said shaft with said tubes of one of said first pair of rollers being positioned on said shaft to interfit in the spaces between said tubes of the other of said first pair of rollers.

3. An apparatus as recited in claim 2, wherein said first pair of rollers have substantially equal radii of curvature.

4. An apparatus as recited in claim 3, wherein each of said first pair of rollers has a radius of curvature greater than the radius of curvature of said rod.

5. An apparatus as recited in claim 4, wherein each of said second pair of rollers includes:

a cylindrical shaft; and a plurality of spaced apart tubes mounted on said shaft with said tubes of one of said second pair of rollers being positioned on said shaft to interfit in the spaces between said tubes of the other of said second pair of rollers.

6. An apparatus as recited in claim 5, wherein said second pair of rollers have substantially equal radii of curvature.

7. An apparatus as recited in claim 6, wherein each of said second pair of rollers has a radius of curvature greater than the radius of curvature of said second rod.

* * * * *